US005081937A

United States Patent [19]

Ishida et al.

[11] Patent Number: 5,081,937

[45] Date of Patent: Jan. 21, 1992

[54] SYSTEM FOR TREATING WASTE MATERIAL IN A MOLTEN STATE

[75] Inventors: Takashi Ishida; Yoshikazu Ueda; Teruji Kubota; Misao Igarashi; Norichika Tanaka; Yasuhiko Kamijo, all of Tokyo, Japan

[73] Assignee: Chiba City & Tsukishima Kikai Kabushiki Kaisha, Tokyo, Japan

[21] Appl. No.: 560,110

[22] Filed: Jul. 31, 1990

Related U.S. Application Data

[62] Division of Ser. No. 460,579, Jan. 30, 1990.

[51] Int. Cl.[5] ..... F23G 5/06

[52] U.S. Cl. ..... 110/246; 110/266

[58] Field of Search ..... 110/266, 254, 210–214; 432/106

[56] References Cited

U.S. PATENT DOCUMENTS

| | | | |
|---|---|---|---|
| 2,800,091 | 7/1957 | Lotz et al. | 110/266 |
| 2,881,720 | 4/1959 | Lotz | 110/266 |
| 2,891,493 | 6/1959 | Gram, Jr. et al. | 110/266 |
| 4,492,566 | 1/1985 | Kreft | 432/14 |
| 4,546,711 | 10/1985 | Kerwin | 432/13 |
| 4,599,955 | 7/1986 | Hepworth et al. | 110/266 |
| 4,685,404 | 8/1987 | Sheppard et al. | 110/266 |
| 4,734,166 | 3/1988 | Angelo, II | 432/109 |
| 4,751,887 | 6/1988 | Terry et al. | 110/246 |

FOREIGN PATENT DOCUMENTS

| | | |
|---|---|---|
| 61-213408 | 9/1986 | Japan . |
| 63-70015 | 3/1988 | Japan . |
| 63-172808 | 9/1988 | Japan . |

*Primary Examiner*—Henry C. Yuen

*Attorney, Agent, or Firm*—Oldham & Oldham Co.

[57] ABSTRACT

An improved system for treating waste material in a molten state wherein the waste material in the form of finely pulverized combustible waste material including incombustible material, e.g., pulverized coal, dried sludge derived from sewerage or the like is burnt in a primary combustion furnace and then burnt in a secondary combustion furnace, the incombustible material is molten to form a flow of molten slag and the resultant molten slag is taken to the outside of the system is disclosed. Floatable dust in the combustion waste gas is collected and agglomerated in the atmosphere of a swirling flow having a high temperature enough to keep the incombustible material in a molten state, whereby a flow of molten slag is produced and then it is cooled so as to allow it to be discharged to the outside of the system. The molten slag may flow back by its own gravity weight to the combustion furnace against a counterflow of the waste gas. Any combustible material in the waste material can be burnt in the combustion furnace at a high efficiency and a temperature in the interior of the furnace can be maintained constant at an elevated level. Further, the resultant molten slag can smoothly be discharged from the combustion furnace to the outside of the furnace.

3 Claims, 11 Drawing Sheets

SYSTEM FOR TREATING WASTE MATERIAL IN A MOLTEN STATE

This is a divisional of copending application Ser. No. 07/460,579 filed on 1-3-90.

BACKGROUND OF THE INVENTION

1. Field of the Invention

The present invention relates generally to a system for treating waste material in a molten state. More particularly, the present invention relates to a system for treating in a molten state waste material such as pulverized combustible material, e.g., dried sludge derived from sewerage, pulverized coal or the like material each including incombustible material in such a manner that the combustible material is burned, the incombustible material is molten in a swirling flow state in a combustion furnace installed in a inclined state with a horizontal attitude and then the molten slag is taken from the combustion furnace to the outside of the system. Further, the present invention relates a system for treating in a molten state fluid waste material such as dried sludge, pulverized coal, industrial waste liquid or the like material each including incombustible material in such a manner that the combustible material is burned, the incombustible material is molten in a combustion furnace, floatable dust carried by combustion waste gas to be discharged to the outside of the system is collected and molten in the high temperature atmosphere of a swirling flow in a dust removing unit installed in an inclined state with a horizontal attitude and the molten slag is collected and then taken from the combustion furnace to the outside of the system.

2. Statement of the Related Art

A swirling flow type combustion furnace which is constructed such that pulverized combustible material such as dried sludge, pulverized coal or the like material each including incombustible material is injected into the interior of the cylindrical combustion furnace together with combustion gas from the end wall or the side wall of the combustion furnace while generating an intense swirling flow, the incombustible material, i.e., combustion ash is molten under the influence of thermal energy derived from combustion and the molten slag is discharged through an outlet port of the combustion furnace has been hitherto known (refer to, e.g., an official gazette of Japanese Laid-Open Patent NO. 213408/1986 (hereinafter referred to as "Prior Invention 1") and a specification of Japanese Patent Application NO. 4489/1987 (hereinafter referred to as "Prior Invention 2").

A swirling flow type combustion furnace as disclosed in the Prior Invention 1 is constructed such that a cylindrical housing of the combustion furnace is installed in an inclined state by a predetermined inclination angle, a plurality of auxiliary burner each including a heavy oil feed pipe and a combustion air feed pipe are arranged on one end wall (end surface on the upstream side) of the combustion furnace, a cylindrical member including a waste gas outlet port on the upper side and a molten slag discharge port at the lower side is coupled to the other end wall (end surface on the downstream side) of the combustion furnace and a pulverized combustible material feed port and a combustion air inlet port are arranged at the upper part of the outer surface of the combustion furnace at positions in the vicinity of the end surface on the upstream side. Each of the auxiliary burners is designated in a concentrical doubled-layer structure comprising a heavy oil feed pipe and an air feed pipe, and a plurality of guide blades for generating a swirling flow are attached to the foremost end of each auxiliary burner.

On the other hand, the Prior Invention 2 discloses a swirling flow type combustion furnace installed in an inclined state with a horizontal attitude wherein the combustion furnace comprises a primary combustion furnace and a secondary combustion furnace. The secondary combustion furnace is formed with a combustion air feed port at an intermediate zone through which oxygen required for combustion can be introduced into the interior of the combustion furnace. In addition, the combustion furnace is provided with an orifice-shaped baffle plate so that a part of the interior of the combustion furnace upstream of the baffle plate is divided into three sections, i.e., an upstream zone, an intermediate zone and a downstream zone.

Further, a method and an apparatus for treating waste material in the form of fluid combustible material such as dried sludge, pulverized coal or the like material each including incombustible material by way of the steps of burning the waste material while generating an intense swirling flow along the inner wall surface of a combustion furnace in the presence of combustion air, melting the incombustible material and discharging the resultant molten slag to the outside of the combustion furnace have been hitherto known.

With the foregoing method and apparatus, floatable dust is generated in the swirling flow, while molten slag to be discharged out of the combustion furnace is deposited on the bottom of the combustion furnace. As the floatable dust is transferred to a subsequent step, it is transformed into a liquid phase, a solid phase or an intermediate phase including the both liquid and solid phases depending on a manner of variation of temperature in the apparatus and physical properties of components included in the waste material, e.g., a melting point and others.

Such floatable dust has a substantial effect on operations of essential units at a subsequent step, e.g., a heat exchanger, an electrical type dust collector or the like unit. The aforementioned behaviors have been already known.

When waste material is treated and incombustible material is molten, floatable dust to be discharged to the outside together with waste gas is generated under a condition that the waste gas flows at a high speed while swirling in the furnace atmosphere. Accordingly, it is required that a proper measure is taken such that the floatable dust is not transferred to the subsequent step. Otherwise, an operational load of various units in the waste gas processing system, e.g., a dry type electrical dust collector, a heat exchanger, a reheating boiler or the like unit is unavoidably increased at the subsequent step.

To remove floatable dust generated in a combustion furnace, it has been proposed that the floatable dust is caused to collide against a bath of molten slag, as disclosed in an official gazette of Japanese Laid-Open Patent NO. 70015/1988 (see FIG. 19).

However, this proposal has problems that a swirling flow in the combustion furnace is brought into a discharge passage 117 in which waste gas flows at a speed higher than that in the furnace and moreover the discharge passage 117 is opened above the surface of molten slag, whereby the floatable dust is unavoidably carried away directly into the discharge passage 117 without collision against the surface of molten slag.

Other proposal for removal of floatable dust produced in a combustion furnace in which waste material is burnt and incombustible material is molten is such that an inner diameter at the free-board section of a combustion furnace is determined as large as possible in order to correctly match with a low free descending speed of the floatable dust. However, it has been found that this proposal has a problem that the furnace is fabricated at an excessively high cost because of the increased inner diameter.

Another proposal is concerned with a cyclone as illustrated in FIG. 20. According to this proposal, floatable dust can be collected at the highest efficiency but it has been found that this proposal has still problems that gas duct is complicated in structure, the temperature on the wall surface of the cyclone is largely lowered as heat is radiated therefrom because the wall surface of the cyclone is designed very large compared with a quantity of waste gas to be discharged and moreover there tend to occur such malfunctions that floatable dust is adhered to the wall surface of the cyclone due to the foregoing reduced temperature and the housing of the cyclone is liable to clogged with the floatable dust in an extreme case.

It should be added that according to the aforementioned prior inventions, a floatable dust removal efficiency in the atmosphere at a high temperature is usually not in excess of 90%.

SUMMARY OF THE INVENTION

The present invention has been made with the foregoing background in mind.

An object of the present invention is to provide a system for treating waste material in a molten state wherein combustible material in the waste material can be burnt in a combustion furnace at a high efficiency, a temperature in a combustion furnace can be maintained constant at an elevated level, incombustible material in the waste material can completely be molten in the form of molten slag which can smoothly be removed from the combustion furnace.

Other object of the present invention is to provide a system for treating waste material in a molten state wherein all units and components required for the system can effectively be controlled without fail.

Another object of the present invention is to provide a system for treating waste material in a molten state wherein floatable dust in waste gas can be collected at a high efficiency and the collected floatable dust as well as the waste gas can be discharged in the form of molten slag from the combustion furnace to the outside of the system.

Further another object of the present invention is to provide a system for treating waste material in a molten state wherein there does not occur such a malfunction that essential units and components for the system become clogged with floatable dust as the system is continuously operated for a long period of time.

To accomplish the above objects, there is provided according to one aspect of the present invention a system for treating waste material in the form of sludge in a molten state wherein the sludge is first dried, the dried sludge is then treated at a high temperature in the swirling flow to generate molten slag and the molten slag is cooled later, the improvement wherein after the dried sludge is well mixed with combustion air at a temperature in the range of 400° to 600° C., it is subjected to primary combustion in a primary combustion furnace at a temperature in the range of 1000to 1200° C. while maintaining a swirling state, a fluidized mixture derived from the primary combustion in the primary combustion furnace is fed into the atmosphere for secondary combustion in a second combustion furnace at a temperature in the range of 1350° to 1450° C. while maintaining a swirling flow state, the secondary combustion being achieved by a plurality of temperature raising means arranged in a spaced relationship in a region extending from the upstream side to the downstream side of the secondary combustion furnace to feed combustion air in a divided state, after completely molten slag is displaced from the secondary combustion furnace to a slag discharging section, the molten slag is cooled to be taken from the system as cooled slag, on completion of combustion, floatable dust is removed from waste gas and thermal energy included in the waste gas is transferred to fresh air by heat exchanging between the waste gas and the fresh air, and the thus preheated air is distributed into the temperature raising means to be used as combustion air for combustion in the primary combustion furnace and the secondary combustion furnace.

Further, according to other aspect of the present invention, there is provided a system for treating waste material in a molten state wherein the waste material including combustible material and incombustible material is burnt at a high temperature to produce molten slag and the resultant molten slag is cooled to receive final treating, the improvement wherein waste gas discharged from a combustion furnace is introduced into a floatable dust removing unit in which floatable dust in the waste gas is collected and agglomerated to produce molten slag in the atmosphere of a swirling flow having a high temperature which is determined at least within the range of allowing incombustible material in the waste material to be molten in the swirling flow, and the resultant molten slag flows down by its own dead weight to the discharging side of the combustion furnace against a counterflow of the upward flowing waste gas.

Furthermore, according to another aspect of the present invention, there is provided a system for treating waste material in a molten state wherein the waste material including combustible material and incombustible material is burnt at a high temperature to produce molten combustion ash or molten slag and the resultant molten combustion ash or the molten slag is cooled to receive final treating, the improvement wherein waste gas discharged from a combustion furnace or a melting furnace is introduced into a floatable dust removing unit in which floatable dust in the waste gas is treated at a high temperature in the atmosphere of a swirling flow to be molten, the floatable dust which has not been molten is collected and agglomerated to produce a flow of molten slag and the resultant molten slag flows flows down by it own dead weight to the discharging side of the combustion furnace or the melting furnace against a counterflow of the upward flowing waste gas.

Other objects, features and advantages of the present invention will be apparent from reading of the following description which has been made with reference to the accompanying drawings.

BRIEF DESCRIPTION OF THE DRAWINGS

FIG. 8(*b*) is a sectional side view of the slag cooler in FIG. 8(*a*).

DESCRIPTION OF THE PREFERRED EMBODIMENTS

Now, the present invention will be described in detail hereinafter with reference to the accompanying drawings which illustrate preferred embodiments thereof.

First, description will be made below with reference to FIGS. 1 to 14 as to a system for treating waste material in a molten state in accordance with an embodiment of a first invention.

Figure 1:
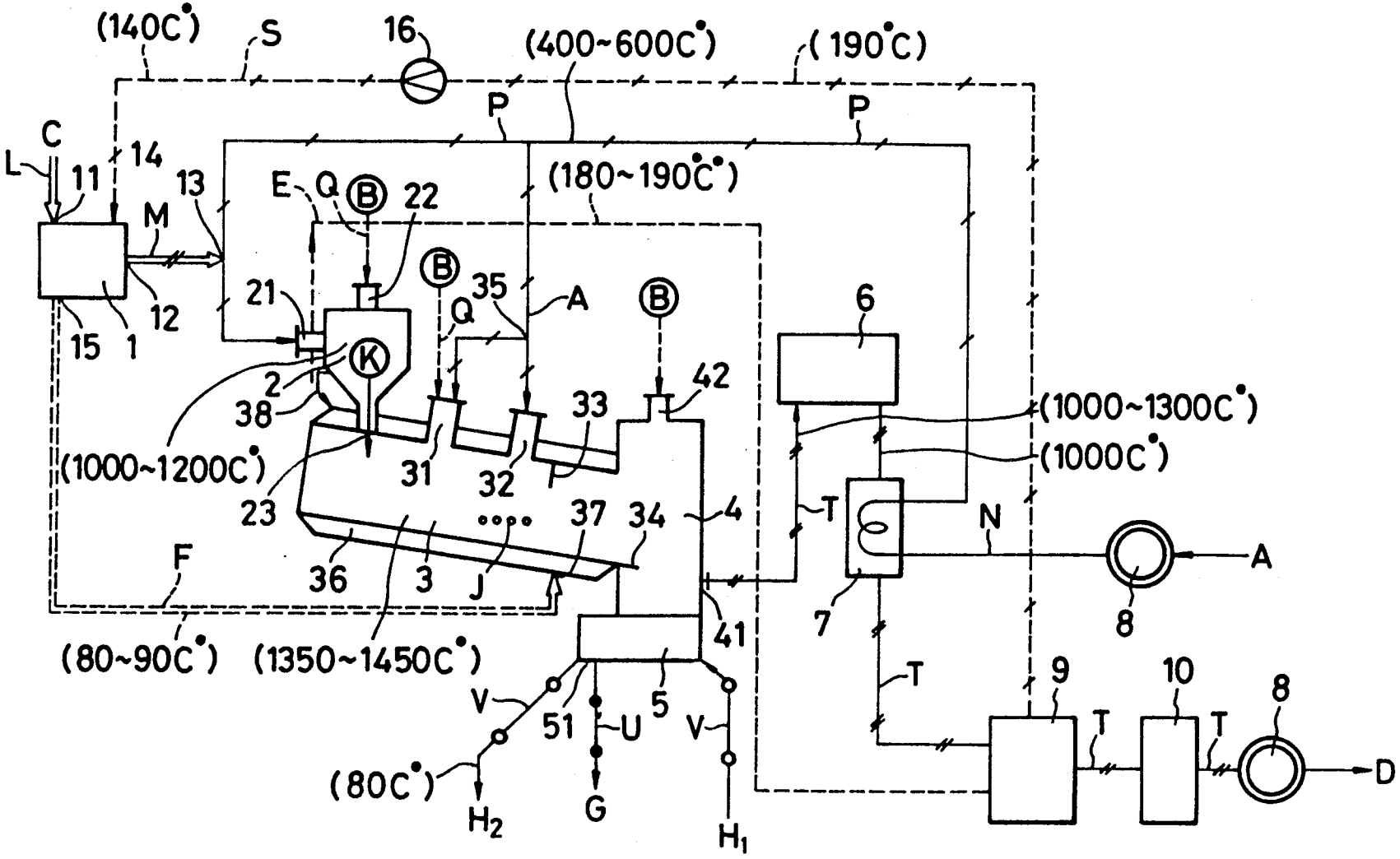
FIG. 1 is a flow sheet schematically illustrating essential units and components for a system for treating waste material in a molten state in accordance with an embodiment of a first invention.
Figure 2:
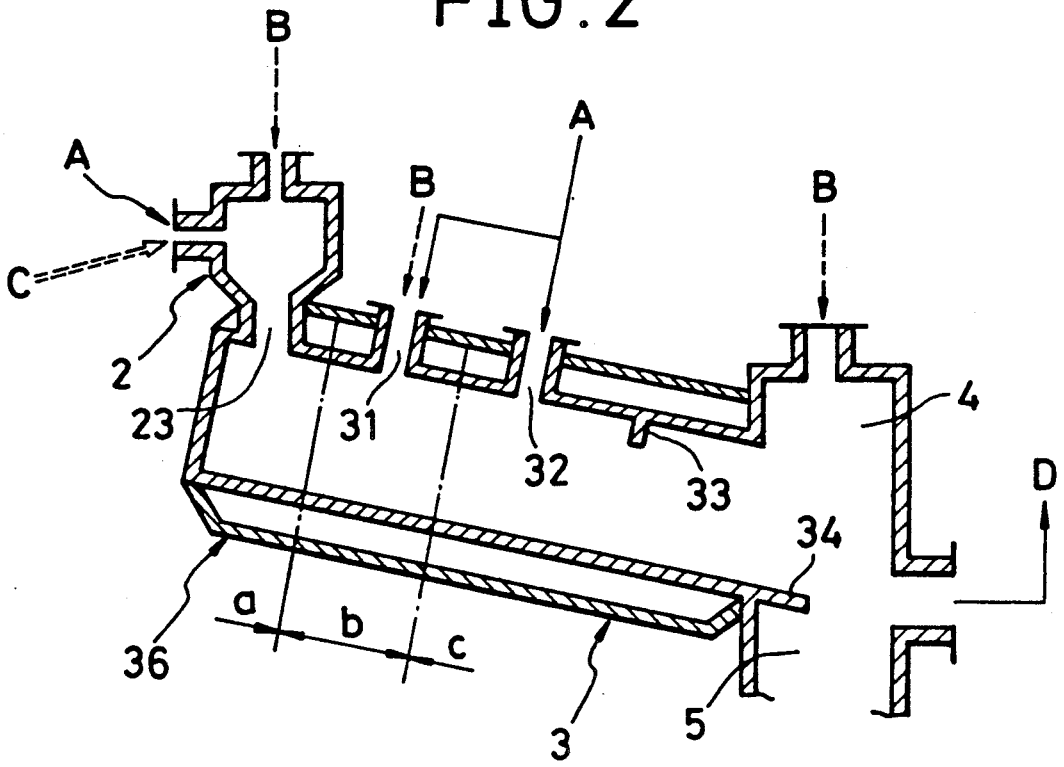
FIG. 2 is an explanatory view, particularly illustrating how combustion air is introduced into the system.

FIG. 1 is a flow sheet which illustrates essential units and components required for the system and FIG. 2 is an explanatory view which schematically illustrates how combustion air is fed into a secondary combustion furnace 3 for operating the system of the present invention.

A waste material M in the form of sludge to be heat treated in the system (hereinafter referred to as sludge) is first dried in a drier 1. The dried sludge M is well mixed with a combustion air A in a mixer 13. It should be noted that the combustion air A is preheated to an elevated temperature of 400° to 600° C. by heat exchanging in a heat exchanger 7 between a combustion air A having a room temperature induced into the heat exchanger 7 by a blower 8 and a waste gas D from the secondary combustion furnace 3. The thus preheated sludge M is introduced into a primary combustion furnace 2 via a feed port 21. For an initial period of combustion, the sludge M is burnt by an auxiliary burner 22 within the atmosphere of a swirling flow. When a fluidized mixture K comprising the dried sludge M and the preheated combustion air A and having a temperature of 1000° to 1200° C. is produced, operation of the auxiliary burner 22 is stopped.

Here, it should be added that the sludge M to be mixed with a combustion air A in the mixer 13 is previously pulverized by operating adequate pulverizing means (not shown). The sludge M is partially burnt in the primary combustion furnace 2.

It is important that floatable dust in the waste gas D is removed from the latter in a floatable dust removing unit 6 before the waste gas D is introduced into the heat exchanger 7 serving as an air preheater. Usually, the waste gas D leaving the secondary combustion furnace 3 has a temperature of 1000° to 1300° C. so that heat exchanging is achieved in the heat exchanger 7 at a temperature of about 1000° C.

The fluidized mixture K is fed from the primary combustion furnace 2 to the secondary combustion furnace 3 in such a manner as to generate a swirling flow in the secondary combustion furnace 3.

Figure 13:
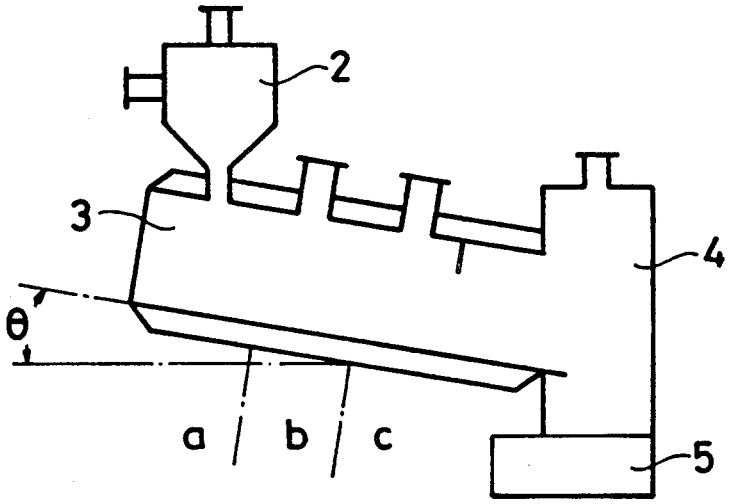
FIG. 13 is a schematic view illustrating items corresponding to claim 6.
Figure 14:
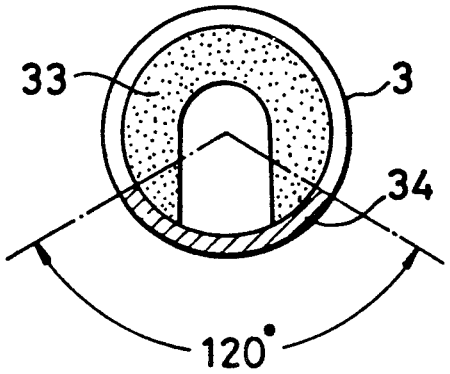
FIG. 14 is a cross-sectional view of a baffle plate having an inverted U-shaped opening formed thereon as seen in the C arrow-marked direction in FIG. 4, while schematically illustrating items corresponding to claim 6.

Referring to FIG. 13, the secondary combustion furnace 3 is installed in an inclined state having an inclination angle THETA in the range of 10 to 45 degrees relative to the horizontal plane. Specifically, the secondary combustion furnace 3 includes a zone a having a feed port 23 on the upstream side through which the fluidized mixture is fed, a zone c having a baffle plate 33 on the downstream side and an intermediate zone b between the both zones a and c of which axial length is properly determined based on a size of the secondary combustion furnace 3. The intermediate zone b includes feed ports 31 and 32 spaced away from each other through which auxiliary combustion air is fed, in such a manner as to generate a swirling flow along the inner wall surface of the secondary combustion furnace 3. As required, the intermediate zone b includes an auxiliary burner in the vicinity of the feed port 31.

A combustion air A to be consumed in the secondary combustion furnace is provided through air supply lines branched from the same air supply line P as that for a combustion air to be consumed in the first combustion furnace 2, and a ratio of a quantity of air to be supplied for the primary combustion furnace 2 to a quantity of air to be supplied for the secondary combustion furnace 3 is set to 50:50. Then, in connection with a fraction of the foregoing distribution ratio represented by 50, a ratio of a quantity of air to be supplied to the feed port 31 to a quantity of air to be supplied to the feed port 32 is set to 25:25 (see FIG. 11). The above-noted ratios represent a fundamental rule of distribution. In practice, they may be adjusted case by case within a deviation of ±20%. The total quantity of air to be supplied to the secondary combustion furnace 3 is distributed at rates of 40 to 60% for the feed port 23 through which the fluidized mixture comprising tertiary air and dried sludge is fed and 20 to 30% for the feed ports 31 and 32 in the zones b and c.

FIG. 2 illustrates a case where the secondary combustion furnace 3 includes two feed ports through which combustion air A is fed into the interior of the secondary combustion furnace 3. Alternatively, the number of feed ports may be increased depending on a length of the intermediate zone b. Additionally, the number of auxiliary burners may be increased, as required. The current ratio of distribution of combustion air A can be adjusted by fed air quantity controlling means (not shown) and moreover a quantity of generated thermal energy can be adjusted by temperature detecting means (not shown).

Normally, the second combustion furnace 3 is controlled such that the fluidized mixture fed from the primary combustion furnace 2 is continuously burnt at a temperature of 1350° to 1450° C. On completion of the combustion in the secondary combustion furnace 3, the fluidized mixture is separated to two phases, i.e., gas and molten slag that is a final product. The molten slag J gradually flows down by its own gravity force along the inclined inner wall surface of the secondary combustion furnace 3 while coming in close contact therewith. Usually, the molten slag is kept very hot at a temperature of about 1450° C. and has an excellent fluidity.

The molten slag J produced in the secondary combustion furnace 3 overflows across the baffle plate 33 and reaches the downstream end of the secondary combustion furnace 3. To easily discharge the molten slag J into a furnace discharge section 4, the secondary combustion furnace 3 is provided with a tongue-shaped molten slag discharge passage 34 at the downstream end thereof. The discharge passage 34 has a concave contour as seen from the above which corresponds to that of the inner wall surface of the secondary combustion furnace 3, and it is projected inside of the furnace discharge section 4. Then, the molten slag J falls down directly in a slag cooling section 5 in which fluidity of the molten slag J is reduced by a cooling operation which will be described later. Thus, the molten slag J is converted into cooled slag G. A shape of the cooled slag G is controlled by adjusting a cooling speed so that the cooled slag J can easily be discharged outside of the secondary combustion furnace 3. Additionally, the furnace discharge section 4 is equipped with an auxiliary burner 42 at a location above the slag discharge passage 34 in order to assure that the molten slag J maintains certain fluidity.

The slag cooling section 5 includes a rotary slag cooler 18 which is cooled with a coolant $H_1$ having a room temperature (about 15° C.). The slag J thermally stuck to the slag cooler 18 is removed by a slag scraper 17 from the slag cooler 18 and it is then discharged to the outside via a slag outlet port 51. Usually, the coolant $H_2$ coming back from the slag cooler 18 has a temperature of about 80° C. (see FIG. 4 and FIGS. 8(*a*) and (*b*)).

Waste gas from the secondary combustion furnace 3 is discharged outside of the furnace discharge section 4 via an exhaust gas outlet port 41 on the side wall of the furnace discharge section 4 at a position opposite to the slag discharge passage 34.

The secondary combustion furnace 3 is surrounded by a condensed water heating jacket 36 having a certain pressure resistance. A condensed water F (having a temperature lower than about 90° C.) coming from the drier 1 reaches an inlet port 37 on the jacket 36 through which it is introduced into the interior of the jacket 36. The condensed water F is heated up to an elevated temperature (180° to 190° C.) by absorbing via the wall structure of the cylindrical furnace thermal energy generated in the interior of the secondary combustion chamber 3 and then it leaves the jacket 36 via an outlet port 38 in the form of high temperature/high pressure water. This high temperature/high pressure water is thermally processed in a boiler 9 in the presence of the waste gas D delivered to the boiler 9 via the heat exchanger 7 so that it is converted into high pressure steam. This high pressure steam is adjusted to a certain constant pressure by a pressure reducing valve 16 disposed midway of a steam supply line S so that it is delivered to the drier 1 to serve as a heating energy source. Process steam in the drier 1 has a temperature of about 140° C.

Next, description will be made below as to the baffle plate 33 in the secondary combustion furnace 3. Specifically, the baffle plate 33 has an opening ratio of 20 to 40% (25 to 30% in terms of an average value) relative to a cross-sectional area of the secondary combustion furnace 3. Here, the opening ratio is represented by the following equation.

$$\text{opening ratio} = \frac{\text{area of an opening}}{\text{cross-sectional area of furnace}} \times 100$$

Once the opening ratio is determined and the kind of raw material to be heat treated is selected, the above-described treatment can be carried out with the thus determined opening ratio without any particular problem. A width of the slag discharge passage 34 is dimensioned such that an elevation angle defined relative to the center of the secondary combustion furnace 3 is determined within the range of 120° C. (see FIG. 14).

In addition, all the pipe lines each requiring sufficient thermal insulation, e.g., a combustion air supply line, a secondary combustion furnace jacket water discharge line, a high pressure/high temperature water line etc. are lined with suitable thermal insulating material.

It should be added that a jacket constituting the outer wall of the secondary combustion furnace is designed and constructed in the form of a pressure resistant structure in which high pressure/high temperature water can be received.

To facilitate understanding of the first invention, it will be helpful that units and mediums required for the system of the present invention are again represented by reference numeral and reference characters in the following manner.

Figure 6:
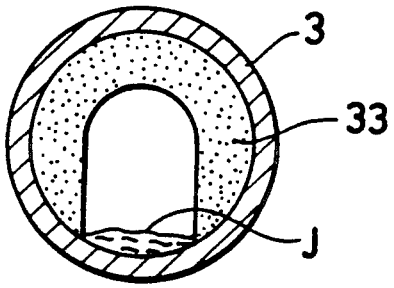
FIG. 6 is a cross-sectional view of the secondary combustion furnace taken in line A—A in FIG. 4, particularly illustrating the contour of a baffle plate which is formed with an inverted U-shaped opening.
Figure 7:
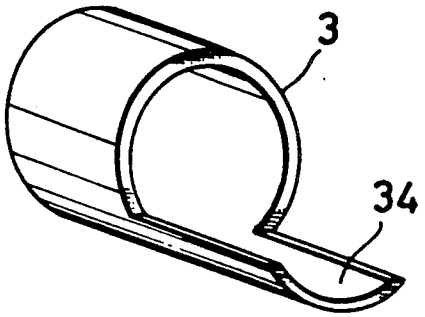
FIG. 7 is a perspective view, particularly illustrating a slag discharging passage projecting from the bottom of the secondary combustion furnace.
Figure 8A:
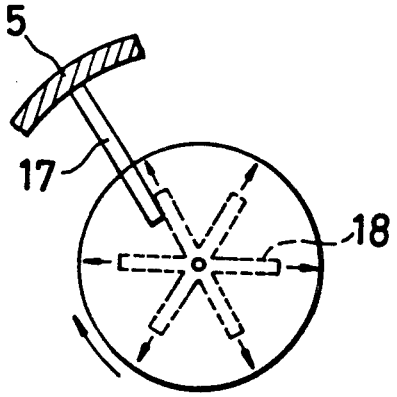
FIG. 8(*a*) is a plan view illustrating a slag cooler adapted to be operated in cooperation with a slag scraper.
Figure 8B:
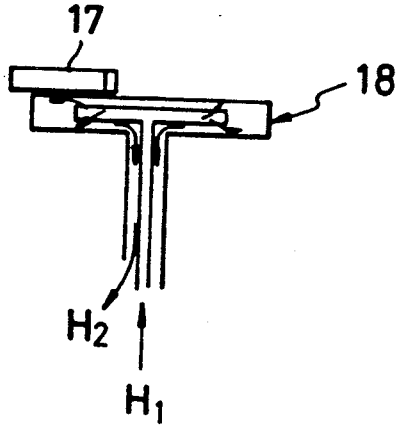
Figure 9:
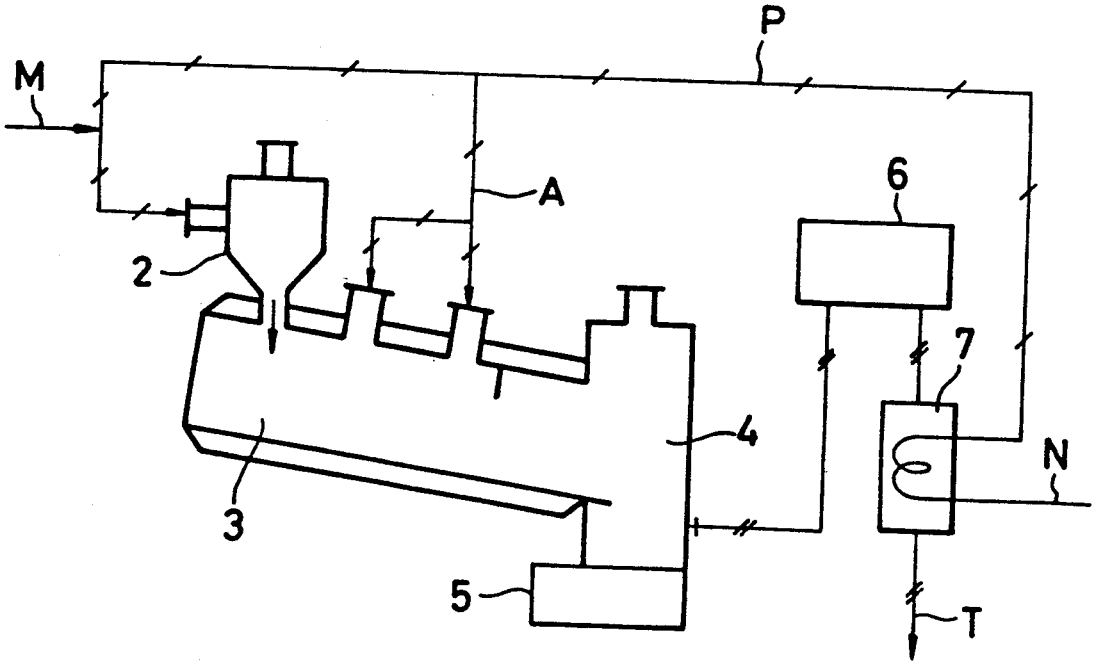
FIG. 9 is a schematic view illustrating items corresponding to claim 1.
Figure 10:
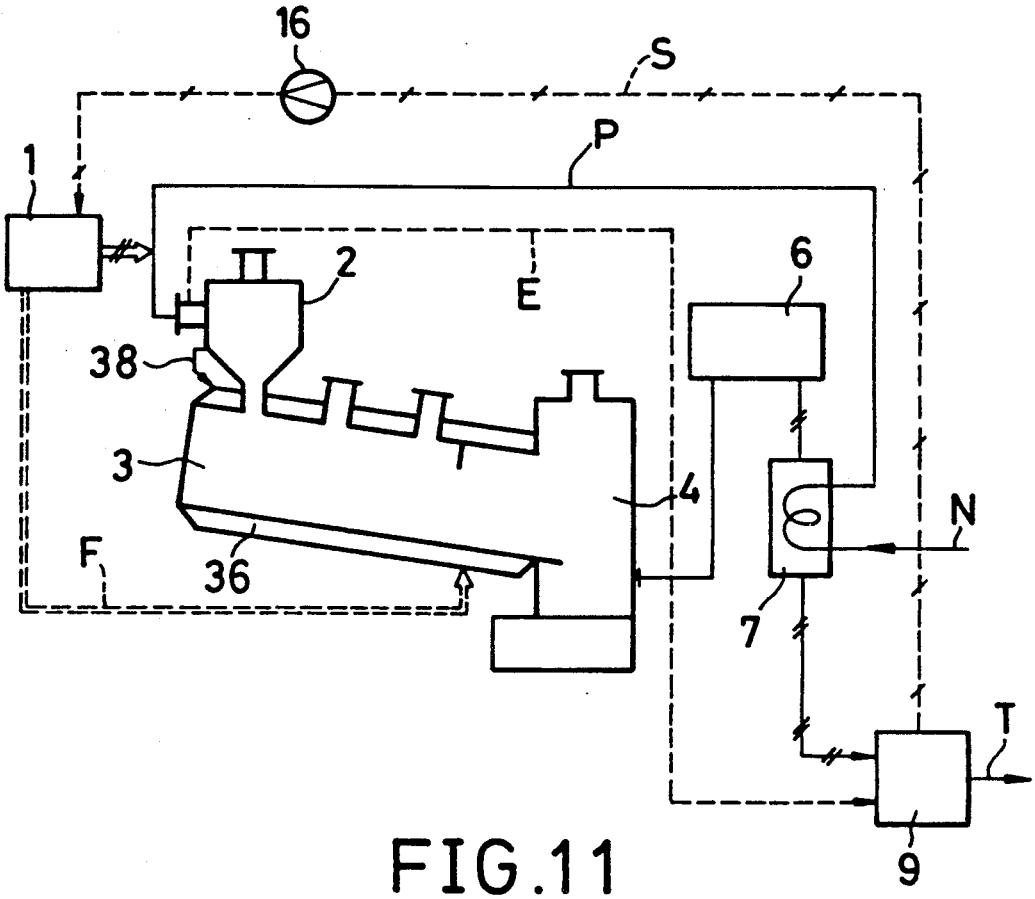
FIG. 10 is a schematic view illustrating items corresponding to claim 2.
Figure 11:
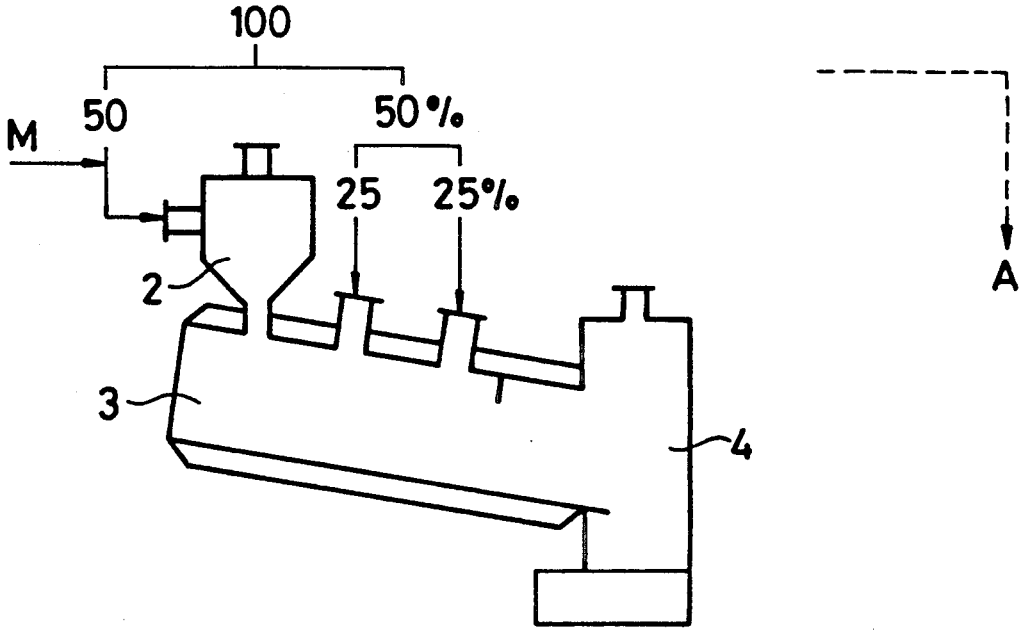
FIG. 11 is a schematic view illustrating items corresponding to claims 3 and 4.
Figure 12A:
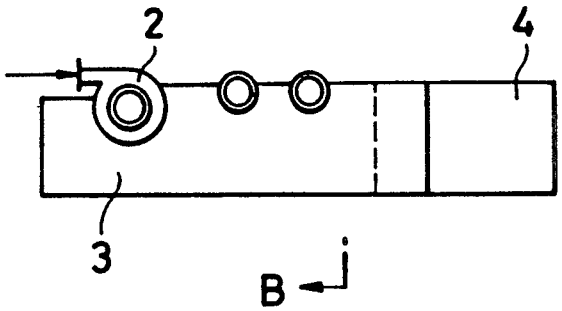
FIG. 12 is a schematic view illustrating items corresponding to claim 5, wherein FIG. 12(*a*) is a view of the secondary combustion furnace as seen in the A arrow-marked direction in FIG. 11 and FIG. 12(*b*) is a view of the secondary combustion furnace as seen in the B arrow-marked direction in FIG. 12(*a*).
Figure 12B:
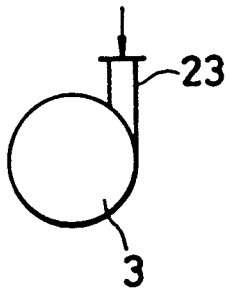

In the drawings, reference numeral 11 designates a feed port of raw material, reference numeral 12 designates an outlet port of dried raw material, reference numeral 13 designates a mixer of raw material and primary air, reference numeral 14 designates a feed port of heated steam, reference numeral 15 designates an outlet port of condensed air, reference numeral 16 designates a pressure reducing valve, reference numeral 17 designates a slag scraper for a slag cooler, reference numeral 18 designates a slag cooler, reference numeral 19 designates an auxiliary fuel inlet port, reference numeral 21 designates a feed port of raw material and air for a primary combustion furnace, reference numeral 23 designates a feed port of a fluidized mixture of tertiary air and raw material, reference numeral 31 designates a feed port of air for a secondary combustion furnace (an auxiliary burner may additionally be provided), reference numeral 32 designates an inlet port of auxiliary air for the secondary combustion furnace, reference numeral 33 designates a baffle plate having an inverted U-shaped opening formed thereon as shown in FIG. 6, reference numeral 34 designates a tongue-shaped concave slag discharging passage extending to the downstream end of the secondary combustion furnace along the bottom of the latter as shown in FIG. 7, reference numeral 35 designates a dividing unit of auxiliary air for the secondary combustion furnace, reference numeral 36 designates a condensed water heating jacket mounted round the secondary combustion furnace, reference numeral 37 designates an inlet port of condensed water for the secondary combustion furnace, reference numeral 38 designates a outlet port of water having a high temperature, reference numeral 4 designates a furnace discharge section, reference numeral 41 designates an outlet port of waste gas from the furnace discharge section, reference numeral 42 designates an auxiliary burner for the furnace discharge section, reference numeral 51 designates an outlet port of cooled slag, reference numeral 6 designates a floatable dust removing unit, reference numeral 7 designates an air preheater, reference numeral 8 designates a blower, reference numeral 9 designates a boiler, reference numeral 10 designates a scrubber, reference character A designates combustion air ($O_2$), reference character B designates fuel (oil), reference numeral C designates sludge (raw material to be heat treated), reference character D designates waste gas, reference character E designates a pipe line for discharged hot water (hot water mixed with steam), reference character F designates a pipe line for condensed water, reference character G designates cooled slag, reference character $H_1$ designates coolant, reference character $H_2$ designates discharged coolant, reference character J designates molten slag, reference character K designates fluidized mixture, reference numeral L designates a pipe line for raw material to be heat treated (sludge), reference character M designates a pipe line for dried raw material, reference numeral N designates a pipe line for combustion air (having a room temperature), reference character P designates a pipe line for combustion air (preheated), reference character Q designates a pipe line for fuel (oil), reference character S designates a pipe line for heated steam, reference character T designates a pipe line for waste gas, reference character U designates a pipe line for (cooled) slag and reference character V designates a pipe line for coolant.

Next, results derived from operations of the swirling flow slag melting furnace (secondary combustion furnace) as constructed in the above-described manner will be described below in connection with results derived from operations of the conventional swirling flow type slag melting furnace (as disclosed in the Prior Invention 2).

(a) In a case where auxiliary fuel is normally used for the primary combustion furnace:

Physical properties of used dry sludge and operation conditions are as noted below.

| dry sludge (used in common for the both furnaces) | | |
|---|---|---|
| moisture | 1.55% | |
| ash | 35.8% | |
| combustible component | 62.7% | |
| total quantity of generated heat | 3890 | Kcal/Kg based on dried sludge |
| average grain size | 180 | microns |
| quantity of supplied sludge | 120 | Kg/h |
| number of auxiliary combustion air feeding pipes (arranged at the intermediate zone of the secondary combustion furnace) | 2 | (only for the present invention) |

| quantity of supplied combustion air (in terms of air ratio) | present invention | comparative example (prior invention 2) |
|---|---|---|
| primary combustion furnace | 0.6 | 0.8 |
| secondary combustion furnace | 0.6* | 0.4 |

(note*)
0.2 on the upstream side and 0.3 on the downstream side

Table 1 shows results derived from operations which were performed under the above-noted conditions.

TABLE 1

| | present invention | comparative example (prior invention 2) |
|---|---|---|
| furnace temp. | | |
| upstream zone | 1350° C. | 1350° C. |
| intermediate zone | (1) 1400° C.<br>(2) 1450° C. | 1450° C. |
| downstream zone | 1400° C. | 1400° C. |
| Deposited state of slag on end surface of furnace on the upstream side | No slag was deposited. Furnace temp. was kept stable during operation. | Deposition of slag was not recognized after operation for 6 hours. |

(b) In a case where auxiliary fuel was constantly used:

Physical properties of used dry sludge and operation conditions are as noted below.

| dry sludge (used in common for the both furnaces) | |
|---|---|
| moisture | 2.0% |
| ash | 55.5% |
| combustible component | 42.5% |

-continued

| dry sludge (used in common for the both furnaces) | |
|---|---|
| total quantity of generated heat | 2900 Kcal/Kg based on dry sludge |
| average grain size | 180 microns |
| quantity of supplied sludge | 120 Kg/h |
| number of auxiliary combustion air feeding pipes | 2 |

(The auxiliary combustion air feeding pipes were disposed in the intermediate zone of the secondary combustion furnace. An auxiliary burner was disposed in the vicinity of the air feeding pipe on the upstream side of the intermediate zone.)

| | |
|---|---|
| number of auxiliary combustion air feeding pipe for the conventional system (Prior Invention 2) | 1 |
| auxiliary fuel (heavy oil) | 1.0 liter/h |

| | present invention | comparative example (Prior Invention 2) |
|---|---|---|
| primary combustion furnace | — | ○ |
| secondary combustion furnace | ○ | — |

(note)
A small circle mark represents a case where an auxiliary fuel was used. A dashed-line mark represents a case where no auxiliary fuel was used.

| quantity of supplied combustion air (in terms of air ratio) | | |
|---|---|---|
| | present invention | comparative example (Prior Invention 2) |
| primary combustion furnace | 0.6 | 0.8 |
| secondary combustion furnace | 0.6* | 0.4 |

(note*)
0.3 on the upstream side and 0.3 on the downstream side

Table 2 shows results derived from operations under the above-noted conditions.

TABLE 2

| | present invention | comparative example |
|---|---|---|
| furnace temp. | | |
| upstream zone | 1400° C. | 1400° C. |
| intermediate zone | (1) 1400° C.<br>(2) 1400° C. | 1400° C.<br>1400° C. |
| downstream zone | 1400° C. | 1380° C. |
| Deposited state of slag on end surface on the upstream side of furnace | No slag was deposited. Furnace temp. was kept stable during operation. | Deposition of slag was not recognized after operation for 6 hours. |

As will be apparent from the above two examples, the swirling flow type melting furnace (i.e., secondary combustion furnace) of the present invention makes it possible to continuously achieve combustion at a high operational efficiency under a high load for a long period of time.

Figure 3:
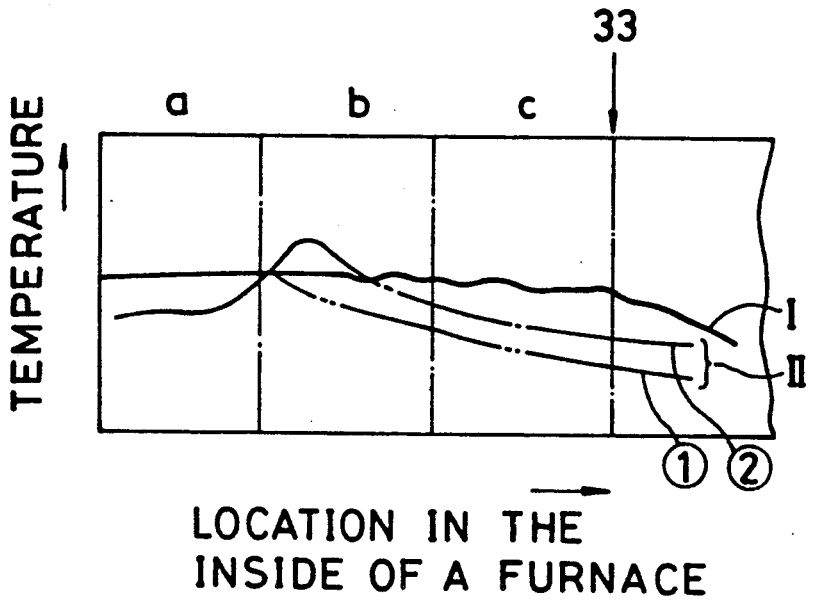
FIG. 3 is an explanatory view, particularly illustrating distribution of a temperature within the interior of a secondary combustion furnace in the system depending on operative states I and II.
Figure 4:
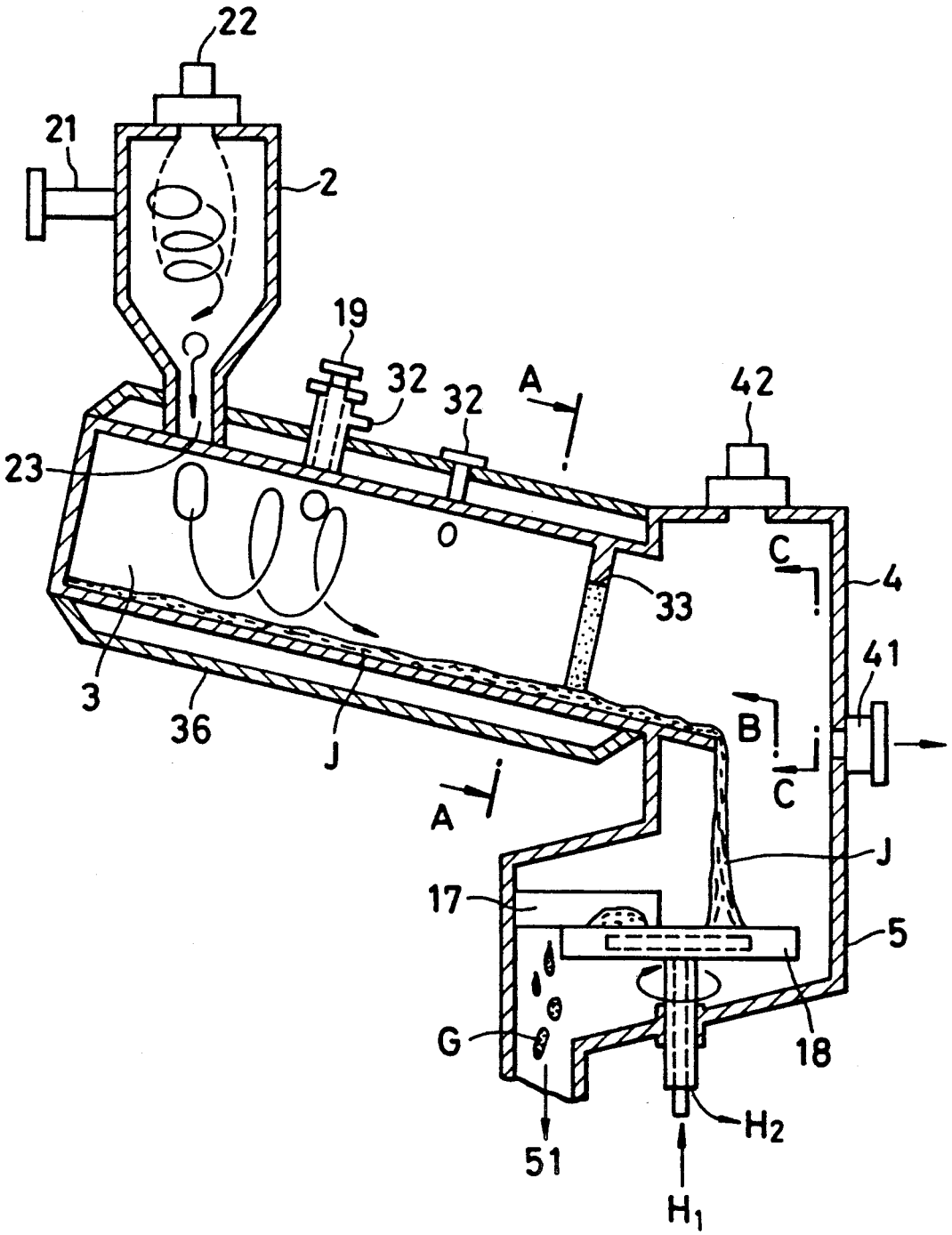
FIG. 4 is a sectional view schematically illustrating a primary combustion furnace, a secondary combustion furnace and a slag cooling section.
Figure 5:
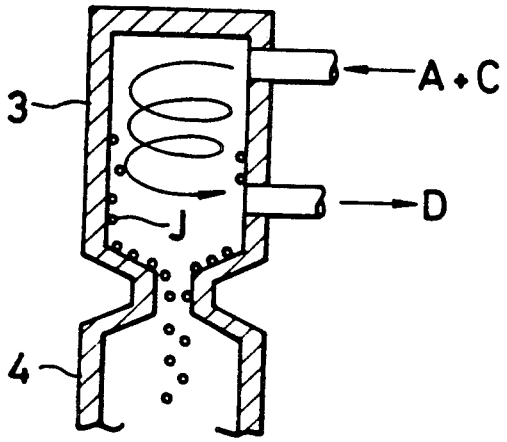
FIG. 5 is a schematic sectional view illustrating a state of displacement of molten slag at a slag discharging section between the secondary combustion furnace and the slag cooling section.

Incidentally, FIG. 3 shows diagrams which represent a relationship between position and temperature in the combustion furnace in the upstream zone a, the intermediate zone b and the downstream zone c with respect to a state I where a temperature in the combustion furnace is controlled as well as a state II where a temperature in the combustion furnace is not controlled in connection with a position assumed by the baffle plate. It is obvious that the temperature is kept stable in the state I.

As will be readily apparent from the above description, the system of the first invention offers the following advantageous effects.

(1) Since waste material to be heat treated is heated up to a sufficiently high level of temperature in a region between the primary combustion furnace and the mixer by thermal energy included in the combustion air, there is few factor of degrading the high temperature atmosphere when the waste material is introduced into the primary combustion furnace.

(2) Since high pressure/high temperature water is employed as a medium for extracting thermal energy from the furnace jacket, a castable refractory material for the second combustion furnace has a temperature which is sufficiently lower than a predetermined temperature at which the castable refractory material is not deteriorated, a frequency of exchanging the castable refractory material with new one can be reduced to one-fourth compared with the conventional system.

(3) The baffle plate in the secondary combustion furnace is formed with an inverted U-shaped opening so as to allow a molten slag itself to provide a weir effect in the presence of the inverted U-shaped opening. Arrangement of the baffle plate assures that a staying time of waste gas in a swirling state in the secondary combustion furnace can be elongated to maintain fluidity of the molten slag.

(4) The number of inlet ports for auxiliary combustion air to be introduced into the secondary combustion furnace can freely be selected while a quantity of combustion air to be consumed in the stable region in the secondary combustion furnace is totally controlled. Thus, an operation of the secondary combustion furnace can easily and automatically be performed corresponding to the current designing of the furnace.

(5) There does not occur such a malfunction that the slag discharging passage is clogged with cooled/solidified slag.

(6) Combustion air is fed to each combustion furnace in a swirling state while flowing along the inner wall surface of the combustion furnace in the tangential direction. Combustible components in waste material to be heat treated can completely be burnt with an ample quantity of oxygen fed into the combustion furnace.

(7) Extracting of thermal energy from the combustion furnace, cooling of the cylindrical structure of the combustion furnace and feeding of thermal energy to the mixer can correctly be controlled using a water jacket and a heat exchanger. Additionally, flow rate, pressure and temperature of thermal mediums flowing through the water jacket and the heat exchanger can freely be adjusted without any particular necessity for maintenance.

Next, a system for treating waste material in a molten state in accordance with an embodiment of a second invention will be described in detail hereinafter with reference to FIGS. 15 to 18 and FIGS. 21 to 24.

As will be apparent from the following description, the purport of the present invention consists in that waste material in the form of dust floatable in waste gas is treated in a molten state.

Figure 15:
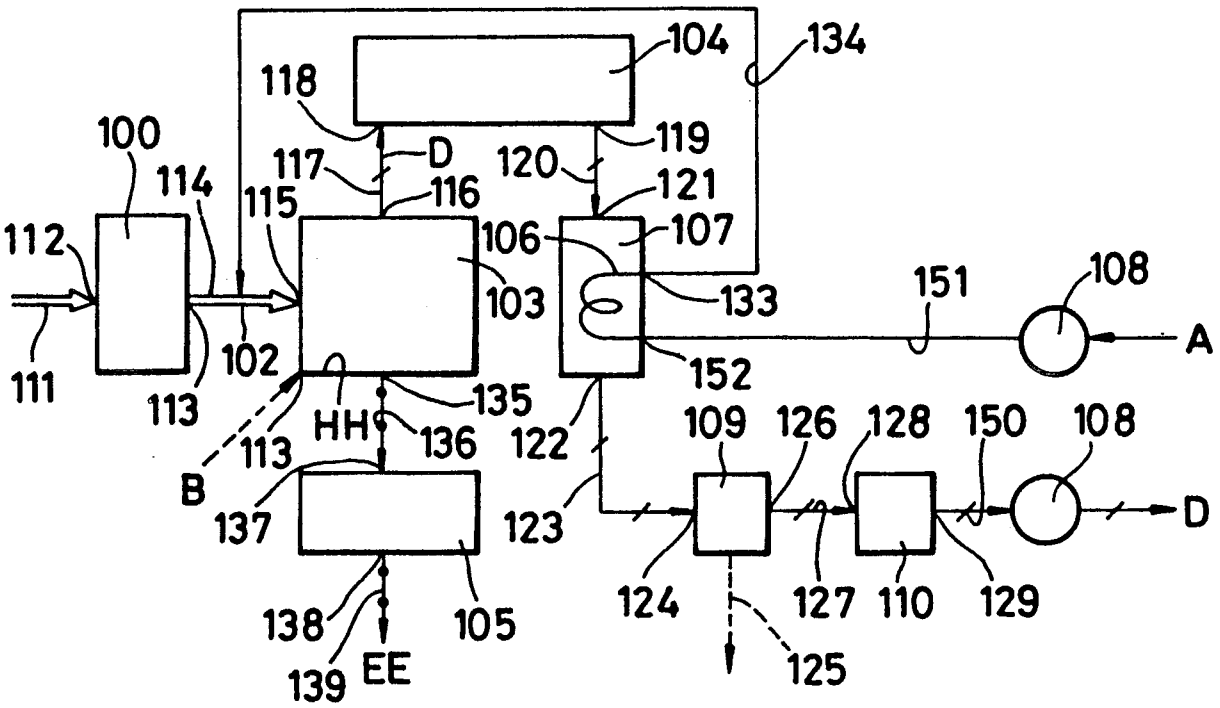
FIG. 15 is a flow sheet schematically illustrating essential units and components for a system for treating waste material in a molten state in accordance with an embodiment of a second invention.

Referring to FIG. 15, waste material C to be heat treated is introduced into a drier 100 via a feeder 111 so that it is dried while reducing its own weight. The dried waste material C is well mixed with combustion air A having a temperature of 400° to 600° C. in a mixer 102 and thereafter the preheated waste material C is fed to a melting furnace 103. As required, the melting furnace 103 is additionally fed with fuel B so that incombustible material in the raw material C is converted into molten slag HH at a high temperature of 1350° to 1450° C. in a swirling flow, while combustible material in the waste material is gasified and discharged to the outside as waste gas D. The molten slag H deposited in a flowing state on the bottom of the melting furnace 103 is discharged as cooled slag EE to the outside of the system via a slag discharging unit 105 which is equipped with a slag cooling device (not shown).

On the other hand, gas in the melting furnace 103 includes floatable dust FF in the form of fine droplets of molten slag and then it leaves the melting furnace 103 as waste gas D having a temperature in the range of 1000° to 1300° C. The waste gas enters in a floatable dust removing unit 104 via a waste gas passage 117 while assuming a swirling flow state. Since the molten slag J in the waste gas D is introduced into the dust removing unit 104 in the above-described swirl flowing state, centrifugal force is exerted on the molten slag J so that the latter comes in close contact with the inner wall surface of the slag removing unit 104. Then, the molten slag J descends into the melting furnace 103 by its own dead weight against a counterflow of the waste gas D by way of the steps of agglomerating the molten slag J on the inner surface of the dust removing unit 104, displacing the molten slag J along the bottom surface of the dust removing unit 104, forming a flow of the molten slag J, displacing the slag flow on the inclined bottom surface of the dust removing unit 104 and displacing the slag flow into the melting furnace 103 via a waste gas inlet port 181. Consequently, the molten slag J is heated by the counterflow of the waste gas D to resume a fluidity, whereby the molten slag J is admixed with the molten slag HH deposited on the bottom of the melting furnace 103 and the slag mixture is discharged to the outside of the system via a waste material discharging unit 105.

After a number of floatable fine droplets of molten dust are removed from the waste gas KK in the dust removing unit 104, the waste gas KK having a temperature of at least about 1000° C. is introduced into the heating side of an air preheater 107 in which its temperature is reduced to a level of about 200° C. or less so that thermal energy of the waste gas KK is utilized to preheat combustion air A. Then, the waste gas KK is delivered further to a boiler 109 in which the residual thermal energy of the waste gas KK is utilized. After the waste gas leaves the boiler 109, residual dust in the waste gas is removed in a scrubber 110 and it is finally discharged to the outside of the system by a blower 108. In case where it is required that dust in the waste gas is more completely removed in the scrubber 110, a dry type electric dust collector (not shown) is added to the scrubber 110.

The air preheater 107 is utilized such that the combustion air A is preheated by thermal energy of the waste gas KK from a room temperature to a higher level in the range of 400° to 600° C. and the preheated air is finally utilized to heat the raw material which is dried in the drier 100. To prevent the waste material discharge passage 136 from being clogged with the molten slag KK until it reaches the waste material discharging unit 105, an auxiliary heating unit (not shown) for additionally heating the molten slag HH should preferably be arranged at the discharge portion (not shown) of the melting furnace 103 to satisfactorily maintain fluidity of the molten slag HH.

Figure 16:
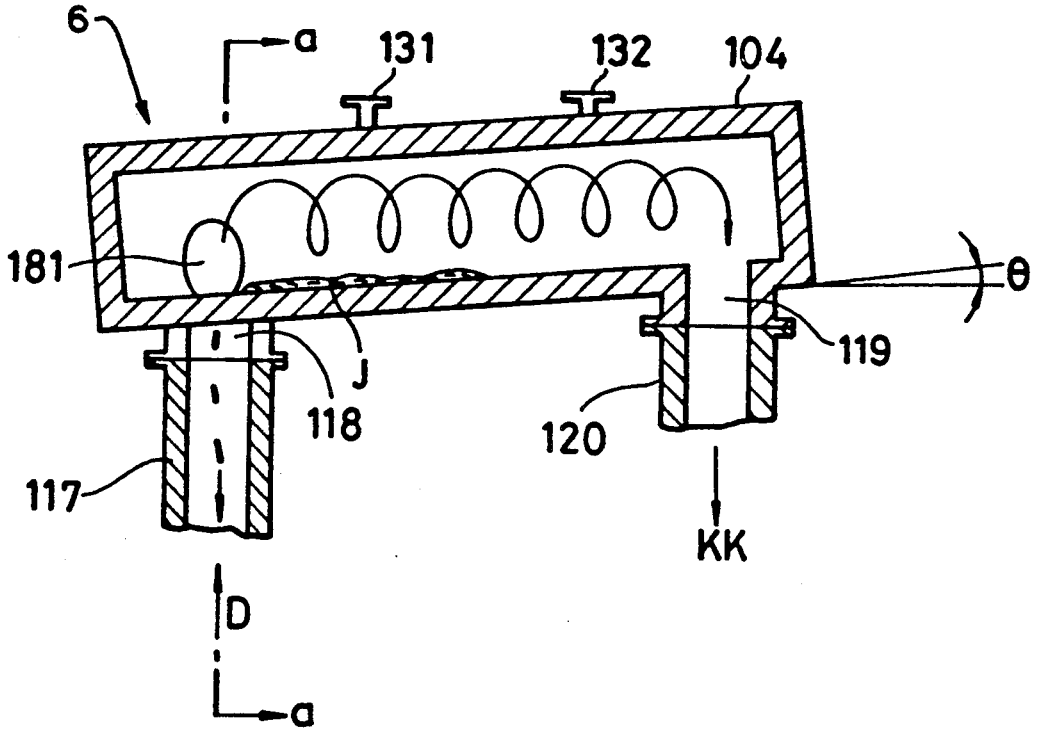
FIG. 16 is a sectional view, particularly illustrating a floatable dust removing unit.
Figure 17:
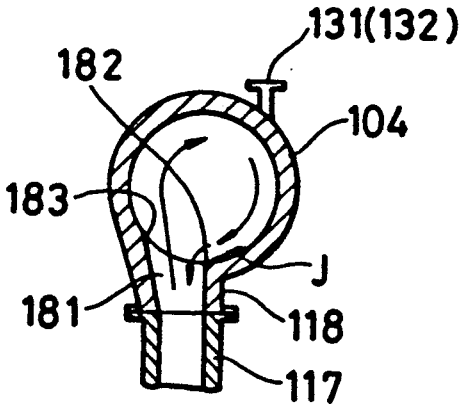
FIG. 17 is a cross-sectional view of the dust removing unit taken in line a—a in FIG. 16, while schematically illustrating items corresponding to claim 15.
Figure 18:
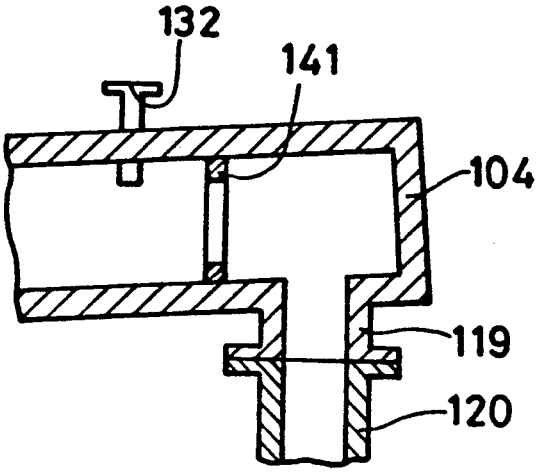
FIG. 18 is a sectional view of the dust removing unit including a baffle plate, while schematically illustrating items corresponding to claim 16.
Figure 19:
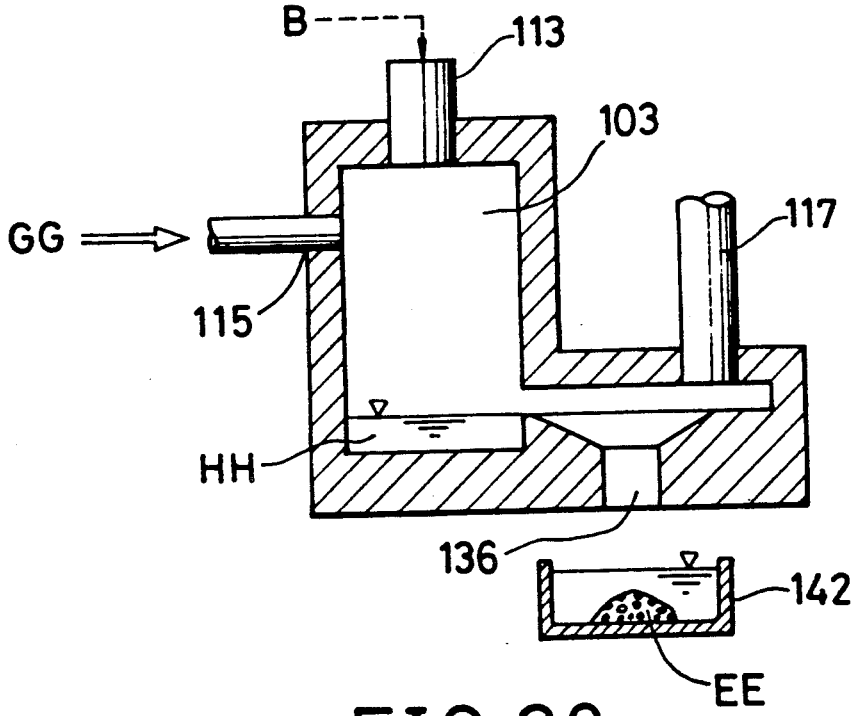
FIGS. 19 is a sectional view illustrating a conventional floatable dust removing unit.
Figure 20:
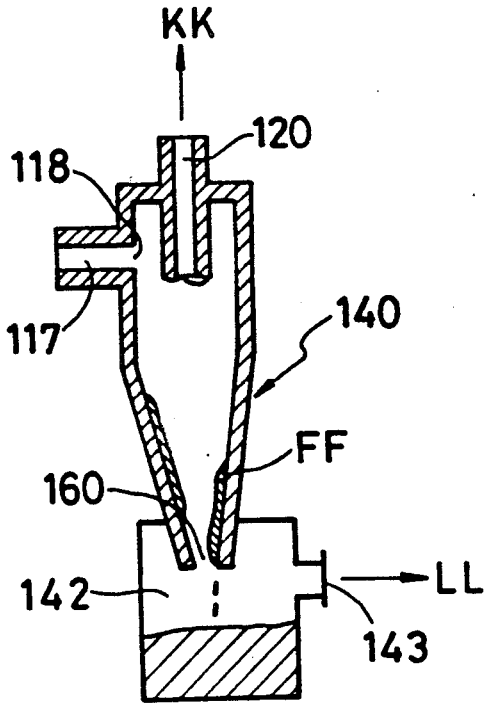
FIG. 20 is a sectional view illustrating a conventional cyclone.
Figure 21:
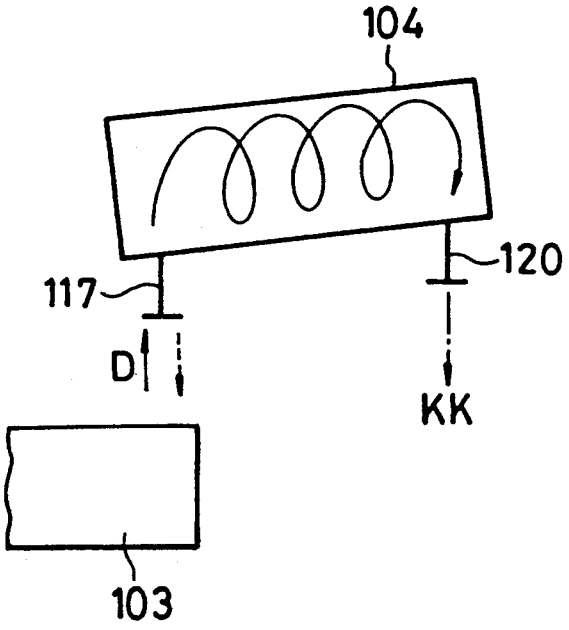
FIG. 21 is a schematic view illustrating items corresponding to claims 8 and 13.
Figure 22:
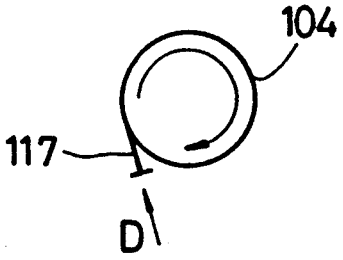
FIG. 22 is a schematic view illustrating items corresponding to claim 9.
Figure 23:
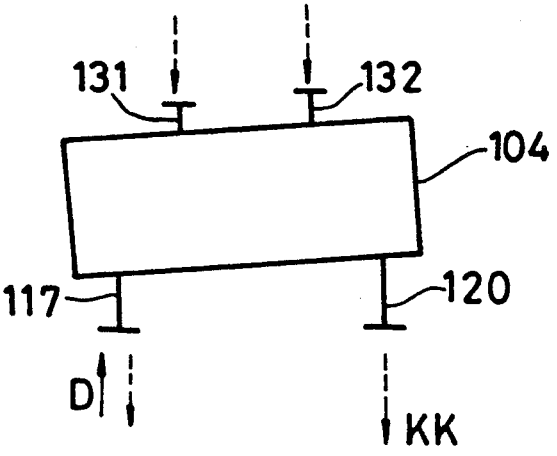
FIG. 23 is a schematic view illustrating items corresponding to claim 9.
Figure 24:
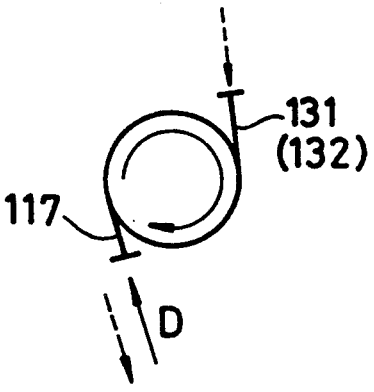
FIG. 24 is a schematic view illustrating items corresponding to claims 11 and 12.

Next, the dust removing unit 104 will be described in more details below with reference to FIGS. 16 to 18.

As shown in the drawings, the waste gas D having floatable dust included therein reaches from the melting furnace 103 via a waste gas passage 117 a waste gas inlet port 118 at the lower end of the cylindrical dust removing unit 104 which is installed in the horizontal direction with a certain uphill inclination angle of THETA, e.g., in the range of 2 to 40 degrees. A flow speed of the waste gas D to enter the dust removing unit 104 is controlled within the range of 15 to 60 m/sec, preferably higher than 30 m/sec. As is best seen in FIG. 17, the waste gas inlet port 181 is designed such that its upper side extends tangential to the inner wall 183 of the dust removing unit 104 so as to create a swirling flow in the interior of the dust removing unit 104 so as to allow the waste gas D to flow along the cylindrical inner wall of the dust removing unit 104. Further, the lower side of the waste gas inlet port 181 is designed to include the lowest surface 182 of the cylindrical structure of the dust removing unit 104, whereby the molten slag J of floatable dust can easily be displaced from the dust removing unit 104 down to the melting furnace 103.

The waste gas D having floatable dust included therein which has been introduced into the dust removing unit 104 is converted into a swirling flow to stay in the dust removing unit 104 for a predetermined period of time. As required, the staying time can be adjusted by a baffle plate 141 on the downstream side of the dust removing unit 104.

Due to introduction of the waste gas D into the interior of the cylindrical structure of the dust removing unit 104 in that way, centrifugal force is always exerted on the waste gas D staying within the atmosphere of the dust removing unit 141. Thus, molten slag droplets of floatable dust are collected on the cylindrical inner wall surface of the dust removing unit 104 under the effect of the aforementioned centrifugal force. In case where it is found that floating material includes non-molten floatable dust in the form of solid phase material or powder material, heating means, i.e., secondary combustion air feeding units 131 and 132 are arranged in an intermediate zone of the cylindrical structure of the dust removing unit 104 so as to liquidize all collected floating materials.

In this manner, the floatable dust collected on the inner wall surface of the cylindrical structure of the dust removing unit 104 is displaced downwardly under the effect of centrifugal force and its own gravity force and increasingly agglomerated in the course of displacement until they are get together to become an agglomerated flow on the bottom surface of the cylindrical structure of the dust removing unit 104. As a result, a bottom flow of the molten slag J is produced along the bottom surface extending downward from the downstream side to the upstream side of the dust removing unit 104.

On the other hand, the waste gas KK from which floatable dust has been completely removed is delivered to a subsequent stage, i.e., a waste gas treating section via a waste gas outlet port 119 on the downstream side of the dust removing unit 104.

According to the present invention, a jacket (not shown) is mounted round the outer wall surface of the dust removing unit 104 and it is filled with fluid medium so as to prevent the cylindrical structure of the dust removing unit 104 from becoming excessively hot. The heated fluid medium is extracted from the jacket so as to allow it to be delivered to thermal energy utilizing means which is arranged at a separate location where the extracted thermal energy is utilized.

Here, description will be made below as to an embodiment of the present invention wherein no jacket is mounted round the outer wall surface of the dust removing unit 104 to utilize thermal energy.

The dust removing unit 104 was constructed such that it had a diameter of 0.4 m and a length of 3.3 mm as measured along the inner wall surface as a reference for measurement, the outside wall was made of mild steel plate, the inner wall was lined with a thermal insulating silica board as an intermediate layer, the inner most wall adapted to come in contact with waste gas was lined with heat resistance castable ceramic material and the cylindrical structure of the dust removing unit 104 was installed in an inclined state having an inclination angle THETA of 3 degrees. In case where it is found that the molten slag includes molten components each having a higher viscosity, the inclination angle THETA is properly set to a larger value than that of the foregoing embodiment. Incidentally, dried sludge derived from treatment of sewerage was used as raw material.

Results derived from operations performed with the system of the present invention are as shown in Table 3. Case I and Case II show results derived from operations performed with the system of the present invention. Case III shows results derived from operations performed with the same conventional system as that in Case I and Case II with the exception that units required for the system of the present invention were not employed. In the table, the floating material collection efficiency represents results derived measurements at the waste gas passage 117 of the melting furnace 103.

TABLE 3

| Results derived from operations of the system of the present invention | | | |
|---|---|---|---|
| | case I | case II | case III |
| **I. Temperature conditions** | | | |
| temperature of melting furnace | 1303° C. | 1294° C. | 1300° C. |
| temperature of vertical duct | 1250° C. | 1210° C. | — |
| outlet temperature of inclined cylindrical structure | 1236° C. | 1196° C. | — |
| inlet gas flow speed in inclined cylindrical structure | 30 m/sec | 33 m/sec | |
| **II. Initial conditions of supplied raw material** | | | |
| quantity of raw material supplied in melting furnace | 118 Kg/h | 111 Kg/h | 120 Kg/h |
| quantity of inorganic material in raw material | 49.3 Kg/h | 46.3 Kg/h | 49.1 Kg/h |
| **III. Physical properties of raw material** | | | |
| kind | sludge of sewerage | sludge of sewerage | sludge of sewerage |
| component: organic material | 53.1% | 53.6% | 54.1% |
| inorganic material | 41.8% | 41.7% | 40.9% |
| moisture | 5.1% | 4.7% | 5.0% |
| quantity of generated heat (higher value based on dried sewerage melting temperature of inorganic material) | 32450 Kcal/kg 1170° C. | 3200 Kcal/kg 1170° C. | 3250 Kcal/kg 1165° C. |
| **IV Efficiency of collection of floating materials** | | | |
| | case I | case II | case III |
| quantity of production of slag | 49.0 Kg/h | 45.0 kg/h | 44.1 Kg/h |
| rate of collection of inorganic material | 97.4% | 97.1% | 89.8% |

to facilitate understanding of the present invention, it will be helpful that essential components and mediums required for the system of the second invention are represented by reference numerals and reference characters in the following manner.

In the drawings, reference numeral 106 designates an air preheater (heat absorbing side), reference numeral 112 designates a raw material inlet port, reference numeral 113 designates an outlet port of dried raw material, reference numeral 114 designates dried raw material conveyance passage, reference numeral 115 designates an inlet port of dried raw material, reference numeral 116 designates an outlet port of waste gas, reference numeral 118 designates an inlet port of waste gas, reference numeral 120 designates a dust-free waste gas passage, reference numeral 121 designates a dust-free waste gas inlet port, reference numeral 122 designates an outlet port of heat removed waste gas, reference numeral 123 designates a heat removed waste gas passage, reference numeral 124 designates a heat removed waste gas inlet port, reference numeral 125 designates a reheated energy conveyance passage (steam or hot water or gas). reference numeral 126 designates an outlet port of unused waste gas, reference numeral 127 designates a passage of unused waste gas, reference numeral 128 designates an inlet port of scrubber waste gas, reference numeral 129 designates an outlet of scrubber waste gas, reference numerals 131 and 132 designate a secondary combustion air feeding unit, respectively, reference numeral 133 designates an outlet port of heated primary air, reference numeral 134 designates a passage of heated primary air, reference numeral 135 designates a furnace outlet port of heated waste material, reference numeral 137 designates an inlet port of heated waste material, reference numeral 138 designates an outlet port of cooled waste material, reference numeral 139 designates a passage of cooled waste material, reference numeral 140 designates a cyclone, reference numeral 141 designates a baffle plate, reference numeral 142 designates a waste material storage, reference numeral 143 designates a lower outlet port of waste gas, reference numeral 150 designates an unused waste gas controlling passage, reference numeral 151 designates a primary air passage, reference numeral 152 designates an inlet port of primary air to be heated, reference numeral 160 designates an outlet port of floatable waste material, reference numeral 182 designates the lower side of an inlet port of waste gas, reference numeral 183 designates the upper side of an inlet port of waste gas, reference character RR designates a floatable dust, reference character GG designates a mixture of air and raw material to be heat treated and reference character LL designates a waste gas from the lower part of a cyclone.

As will be apparent from the above description, the system in accordance with the second invention will offer the following advantageous effects.

(1) Since a cost is required only for an operation in the waste material combustion furnace, the system can be designed at an inexpensive cost.

(2) With the system of the present invention, floatable dust can easily be removed at a high efficiency in the atmosphere having a high temperature without any danger of causing a malfunction that relevant units are clogged with the waste material.

(3) Heat generated by the dust removal can effectively be utilized for other technical systems rather than the system of the present invention.

(4) A subsequent process or a subsequent step associated with the system of the present invention can be operated at a substantially improved efficiency. Thus, the whole system can be controlled and maintained at a reduced cost.

While a system for treating waste material in a molten state in accordance with first and second inventions has been described above with respect to two typical embodiments, it should of course be understood that these systems should not be limited only to them but various changes and modifications may be made without departure from the scope of the both inventions as defined in the appended claims.

What is claimed is:

1. In an apparatus for treating waste material in a molten state wherein said waste material including combustible material and incombustible material is burnt at a high temperature to produce waste gas and molten combustion ash or molten slag and said molten combustion ash or said molten slag is cooled to receive final treating, the improvement comprising:

a cylindrical dust removing unit including an inner wall surface, a substantially tangential waste gas inlet port on the upstream side thereof and a dust-free waste gas outlet port on the downstream side thereof, a furnace discharge section provided with an exhaust gas outlet port on the side wall thereof, a slag cooling section provided with a rotary slag cooler at the lower end part thereof, and communicating with said furnace discharge section, a waste gas passage extending into the dust removing unit in the substantially tangential direction relative to the inner wall surface of said dust removing unit and communicating with said exhaust gas outlet port of said furnace discharge section, said dust removing unit being mounted such that the upstream side is located below the downstream side so as to allow the dust removing unit to assume an inclined attitude whereby the molten slag flows down countercurrent to said waste gas by its own dead weight and falls down from the lowest part of the inner wall surface of said dust removing unit to said rotary slag cooler.

2. The apparatus as claimed in claim 1, wherein the lower part of said waste gas inlet port is located to include the lowest part of the inner wall surface of the dust removing unit.

3. Apparatus according to claim 1 wherein said dust removal unit is upwardly inclined at an angle in the range of about 2 to about 20 degrees.

* * * * *